US006384787B1

(12) United States Patent
Kim et al.

(10) Patent No.: US 6,384,787 B1
(45) Date of Patent: May 7, 2002

(54) FLAT REFLECTARRAY ANTENNA

(75) Inventors: Yong Uk Kim, Bellflower; John Pong Lim, Anaheim; Andy G. Laquer, Tustin, all of CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/789,984

(22) Filed: Feb. 21, 2001

(51) Int. Cl.[7] ..... H01Q 1/38; H01P 1/18
(52) U.S. Cl. ..... 343/700 MS; 343/781 R
(58) Field of Search ..... 343/700 MS, 909, 343/781 R, 781 P, 779, 781 CA; 333/161, 156

(56) References Cited

U.S. PATENT DOCUMENTS 4,684,952 A * 8/1987 Munson et al. ..... 343/700 MS
4,939,527 A 7/1990 Lamberty et al. ..... 343/771
5,488,380 A 1/1996 Harvey et al. ..... 342/368
5,512,906 A 4/1996 Speciale ..... 342/375
6,061,026 A 5/2000 Ochi et al. ..... 343/700 MS
6,081,234 A * 6/2000 Huang et al. ..... 343/700 MS
6,081,235 A * 6/2000 Romanofsky et al. ..... 343/700 MS
6,147,648 A * 11/2000 Granholm et al. ... 343/700 MS
6,184,827 B1 2/2001 Dendy et al. ..... 342/372
6,195,047 B1 * 2/2001 Richards ..... 343/700 MS

* cited by examiner

*Primary Examiner*—Don Wong
*Assistant Examiner*—James Clinger
(74) *Attorney, Agent, or Firm*—Harness Dickey & Pierce P.L.C.

(57) ABSTRACT

A space-fed, flat, reflectarray antenna apparatus for providing a desired degree of phase shift to a received electromagnetic wave to form a narrow beamwidth signal. The reflectarray antenna, in one form, is provided as a dual reflection antenna having a polarization sensitive subreflector and a reflectarray element spaced apart from the subreflector. The reflectarray element includes a large plurality of independent patch antenna units which each form antenna cells. Each patch antenna unit includes a vertical polarization sensitive antenna, a horizontal polarization sensitive antenna and a microstrip transmission line conjoining the two antennas. The microstrip transmission line of each antenna unit has a predetermined length intended to provide a predetermined degree of phase shift. Each patch antenna unit provides a polarization twist function to cause vertical polarization received by the vertical polarization sensitive antenna to be retransmitted by the horizontal polarization sensitive antenna as a horizontally polarized signal. Advantageously, the antenna is adapted for the insertion of MEMS phase shifters to provide for an electronically scanned antenna.

15 Claims, 5 Drawing Sheets

FLAT REFLECTARRAY ANTENNA

TECHNICAL FIELD

This invention relates to antennas, and more particularly to a flat reflectarray antenna utilizing a polarization twist function and predetermined phase shifts to provide a directed narrow beamwidth signal.

BACKGROUND OF THE INVENTION

Radar systems require some form of an antenna to produce a narrow beamwidth signal. A millimeter wave antenna has a unique requirement in that a large number of radiating elements must be integrated into a very small aperture space. Conventional corporate feed networks that are required to feed these antennas are impractical due to the extensive mechanical complexity of the network and inherent high insertion losses.

One specific type of antenna used in radar applications is the flat reflectarray antenna. This type of antenna is used for providing antenna beam collimation in place of curved, volumetric parabolic dishes because the flat surface of a reflectarray antenna can be easily stowed and deployed, and also occupies very little space. Furthermore, the flatness of such an antenna is easily maintained. However, such antennas are limited to produce a signal directed to a fixed angle.

It would therefore be desirable to provide a space fed, flat reflectarray antenna which is capable of producing a directed, narrow beamwidth signal by the selection of appropriate phase shifts.

Furthermore, it would be desirable to produce such a space-fed, flat reflectarray antenna incorporating a polarization twisting scheme to allow the reflectarray to be incorporated into a dual reflection type antenna system.

SUMMARY OF THE INVENTION

The above and other objects are provided by a space-fed, flat reflectarray antenna in accordance with the preferred embodiments of the present invention. It is a principal advantage of the antenna of the present invention that the antenna incorporates a plurality of patch antenna units formed on a thin dielectric layer. The flat reflectarray antenna is presented in an "inverse Cassegrain antenna" configuration and incorporates a polarization twisting scheme.

In one preferred embodiment a feed horn illuminates a subreflector. The subreflector is polarized and reflects the signal received from the feed horn back to a reflectarray element. The reflectarray element incorporates the plurality of patch antenna units and uses the patch antenna units to rotate or "twist" the received signal to change the polarization of the received signal and to radiate therefrom a narrow beamwidth signal back towards the subreflector. In one preferred form the subreflector is polarized such that it reflects a vertically polarized signal but is transparent to a horizontally polarized signal, and the patch antenna units rotate the received signal from a vertically polarized signal to a horizontally polarized signal. Each of the patch antenna units includes a vertical polarization sensitive antenna and a horizontal polarization sensitive antenna. The two patch antennas are conjoined by a suitable transmission medium such as, for example, a microstrip transmission line. The length of the microstrip transmission line is selected to provide the desired degree of phase shift to the signal transmitted by the horizontal polarization sensitive patch antenna. The cumulative phase shifts thus produce a collimated antenna beam that points at a desired angle off of the boresight of the antenna.

The flat reflectarray antenna of the present invention further provides the significant benefit of being readily adapted to receive active phase shifting elements. The inclusion of active phase shifting elements enables an antenna to be constructed which is capable of electronically scanning its beam to track a desired target.

BRIEF DESCRIPTION OF THE DRAWINGS

The various advantages of the present invention will become apparent to one skilled in the art by reading the following specification and subjoined claims and by referencing the following drawings in which:

FIG. 6 is a graph showing the normalized far field cut patterns off the patch antenna unit of FIG. 4 at 94 GHz, decomposed along ($\phi$=0,90) degrees by Ludwig's third definition of the polarization;

FIG. 8 is a simplified illustration of the present invention being used in a J-feed antenna configuration.

DETAILED DESCRIPTION OF THE PREFERRED EMBODIMENTS

Figure 1:
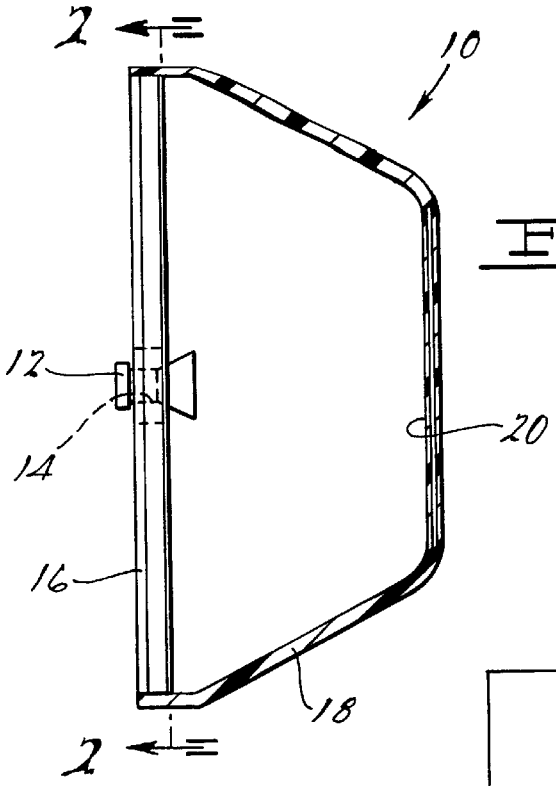
FIG. 1 is a simplified side view of a flat reflectarray antenna in accordance with a preferred embodiment of the present invention.

Referring to FIG. 1, there is shown a space-fed, flat, reflectarray antenna 10 in accordance with a preferred embodiment of the present invention. The antenna 10 is shown as a dual reflection type antenna and includes a pyramidal feed horn 12 disposed within a central aperture 14 of a reflectarray element 16. The reflectarray element 16 is positioned in the open end of a radome 18 having a polarization sensitive subreflector 20 supported therein at an opposite end parallel to the reflectarray element 16. In one preferred form the subreflector 20 is formed by a wire grid orientated vertically to reflect the vertically polarized energy of the signal incident thereon and to pass the horizontally polarized energy of the signal. The feed horn 12 is similarly orientated so as to be vertically polarized.

Figure 2:
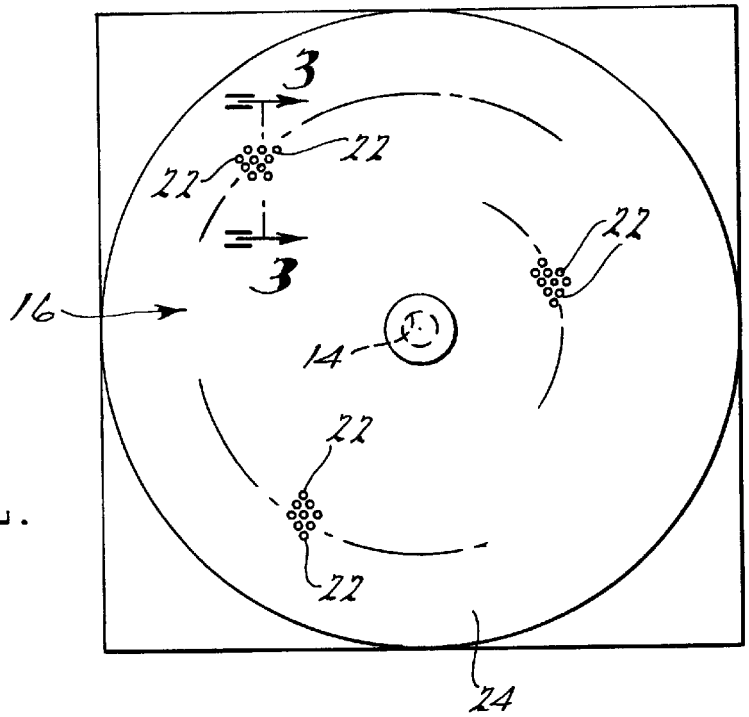
FIG. 2 is a view of the reflectarray element taken in accordance with directional line 2—2 in FIG. 1, but with the feed horn omitted for clarity.
Figure 3:
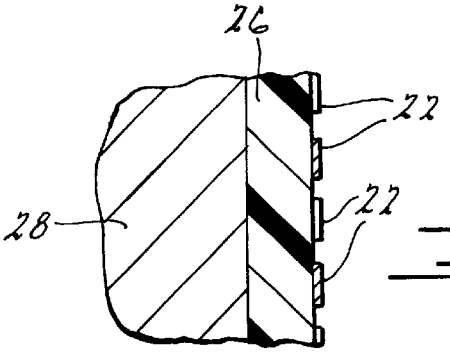
FIG. 3 is a side view of the reflectarray element of FIG. 2 taken in accordance with the section line 3—3 in FIG. 2.

Referring to FIG. 2, the reflectarray element 16 comprises a plurality of patch antenna units 22 disposed or formed on a surface 24 thereof. With brief reference to FIG. 3, the reflectarray element 16 can also be seen to be comprised of a dielectric substrate 26 and a planar ground plane 28. The dielectric substrate 26 needs to be very thin to avoid a scan blindness problem when the beam of the antenna 10 is scanned far off of boresight. The thickness of the dielectric substrate 26 may vary but one preferred form is 0.005 inch (0.127 mm). The dielectric substrate 26, in one preferred form, further has a dielectric constant of about 6.15. The ground plane 28, in one preferred form, is formed by a layer of aluminum cladding. Again, the thickness of the ground plane may vary but in one preferred form is approximately 0.025 inch thick (0.635 mm).

Figure 4:
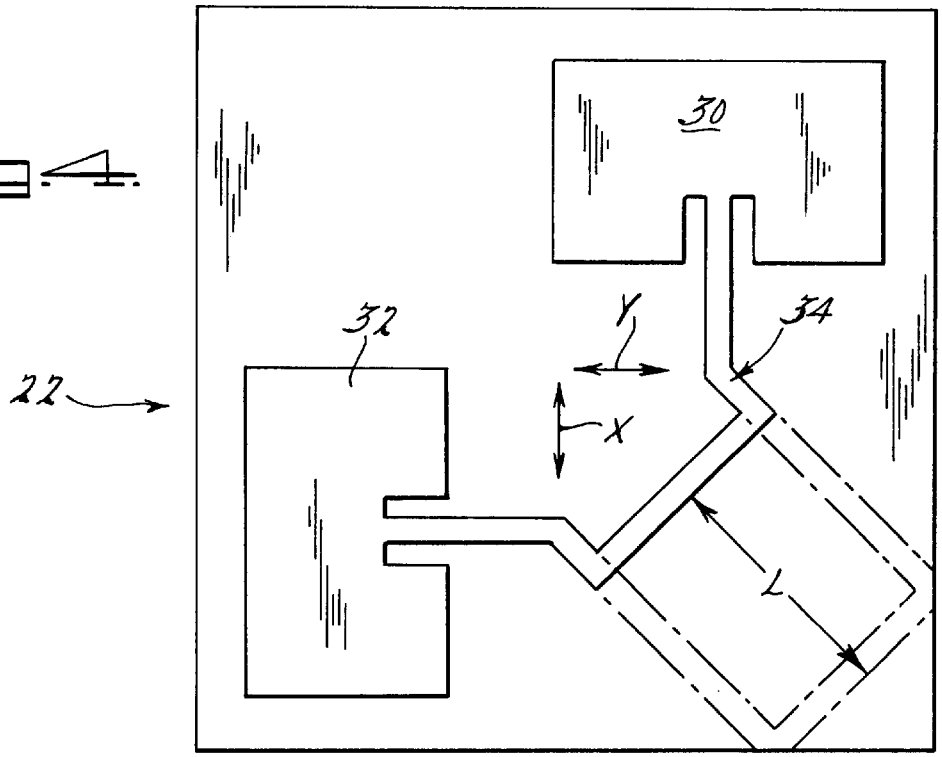
FIG. 4 is a highly enlarged plan view of one of patch antenna unit.

Referring now to FIG. 4, one patch antenna unit 22 is shown in highly enlarged fashion. Each patch antenna unit 22 comprises a vertical polarization patch antenna 30, a horizontal polarization patch antenna 32 and a transmission medium 34 coupling the two antennas 30 and 32. In one preferred form the transmission medium comprises a microstrip transmission line conjoining the two antennas 30 and 32. The dimensions of each patch antenna unit 22, which can each be viewed as a "cell" disposed closely adjacent one another, may vary widely. However, in one preferred form each of the patch antenna units 22 comprises dimensions of approximately 0.08 inch by 0.08 inch (0.2 mm ×0.2 mm). The microstrip transmission line 34 is preferably printed on the dielectric substrate 28 and may vary in width. In one preferred form, however, the micro strip transmission line 34 has a width of about 0.003 inch (0.076 mm). It has been determined that at 94 GHz, the effective dielectric constant of the dielectric substrate 28 is about 4.3 and the characteristic impedance of the microstrip transmission line 34 is about 78 ohms.

The performance of each patch antenna unit 22 is optimized in an array environment. When an array is very large, it is common practice to make the "infinite array" assumption to model the array. According to Floquet's theorem, when an array has an infinite periodic structure, the field of a single patch antenna unit 22 repeats in every unit except for a propagation factor. Hence, one just needs to consider a single patch antenna unit 22 with proper environment matching boundary conditions to simulate the infinite array.

Figure 5:
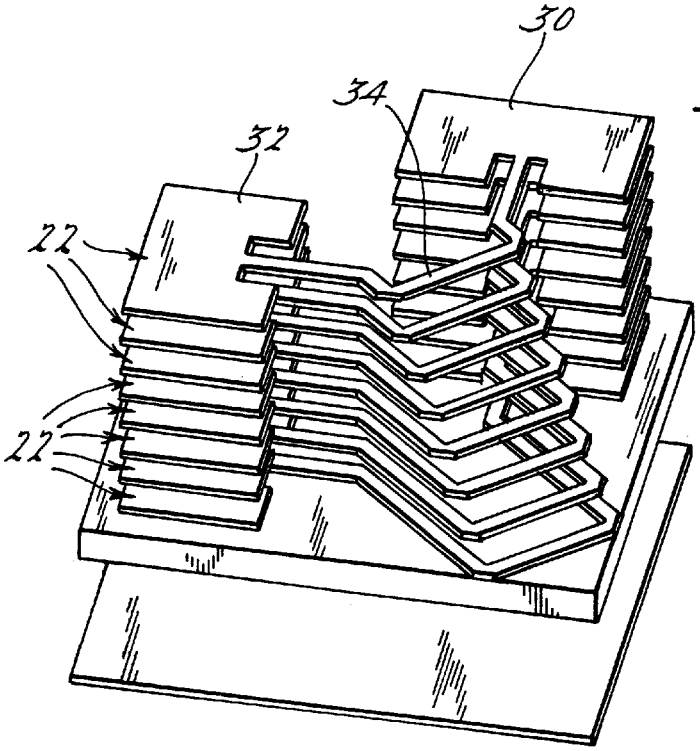
FIG. 5 is a perspective view of a plurality of patch antenna units disposed vertically adjacent one another to illustrate the different lengths of microstrip transmission lines needed to achieve different degrees of phase shift.
Figure 5:
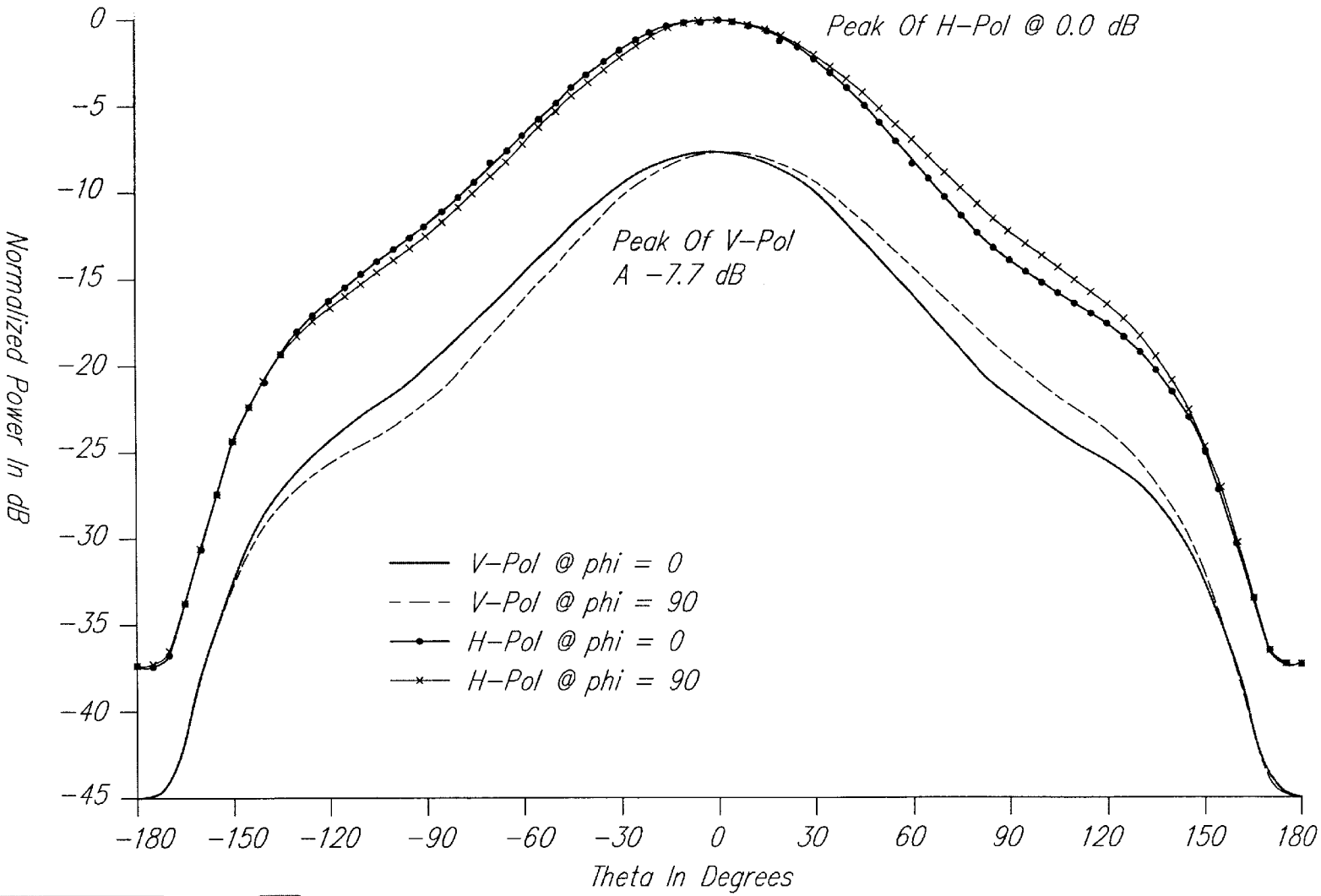

Referring now to FIG. 5, the preferred embodiment of the reflectarray antenna 10 is capable of simulating a three bit phase shifter system. Thus, for a three bit phase shifter, there can be $2^3$=8discrete phase values with 45° increments. FIG. 5 illustrates the resulting eight patch antenna units 22 disposed one above the other for comparison purposes. Each patch antenna unit 22 shown in FIG. 5 is identical in construction and dimensions with the exception of the length "L" of the microstrip transmission line 34. The length of the microstrip transmission line 34 is varied to achieve the desired phase shift.

The table below illustrates the approximate length "L" (in mils) of the microstrip transmission line 34, as also indicated in FIG. 4, needed to achieve the given degree of phase shift.

| patch no. | L(mil) | Δϕ(deg) |
|---|---|---|
| 1 | 0.00000 | 0 |
| 2 | 3.75341 | 45 |
| 3 | 7.50683 | 90 |
| 4 | 11.26024 | 135 |
| 5 | 15.01365 | 180 |
| 6 | 18.76706 | 225 |
| 7 | 22.52048 | 270 |
| 8 | 26.27389 | 315 |

The antenna patch units 22 are preferably ion-beam etched onto the dielectric substrate 28 and arranged as needed to produce a main beam which is directed at a desired angle relative to the boresight of the antenna 10. It will be appreciated that in practical applications a very large number of the patch antenna units 22 will be required. One such prototype constructed by the assignee consisted of 5,164 patch antenna units 34 formed as part of a reflectarray element having a diameter of about only 6.5 inches (1 6.51 cm).

Returning now to FIG. 1, in operation the feed horn 12 is orientated to provide a vertically polarized signal directed at the subreflector 20. This vertically polarized signal is reflected off of the subreflector 20 and back towards the reflectarray element 16. The subreflector 20 passes horizontally polarized energy therethrough without obstruction. The reflected, vertically polarized energy of the signal is received by the vertical polarization sensitive patch antenna 30 of each patch antenna unit 22 and then transmitted via its associated microstrip transmission line 34 to its associated horizontal polarization sensitive patch antenna 32.

The microstrip transmission line 34 provides the desired degree of phase shift while the horizontal polarization patch antenna 34 provides a polarization "twist" function by retransmitting a horizontally polarized signal back towards the subreflector. This horizontally polarized signal now passes through the subreflector 20. The result is a directed, narrow beamwidth, collimated signal produced by desired phase shifts.

Figure 7:
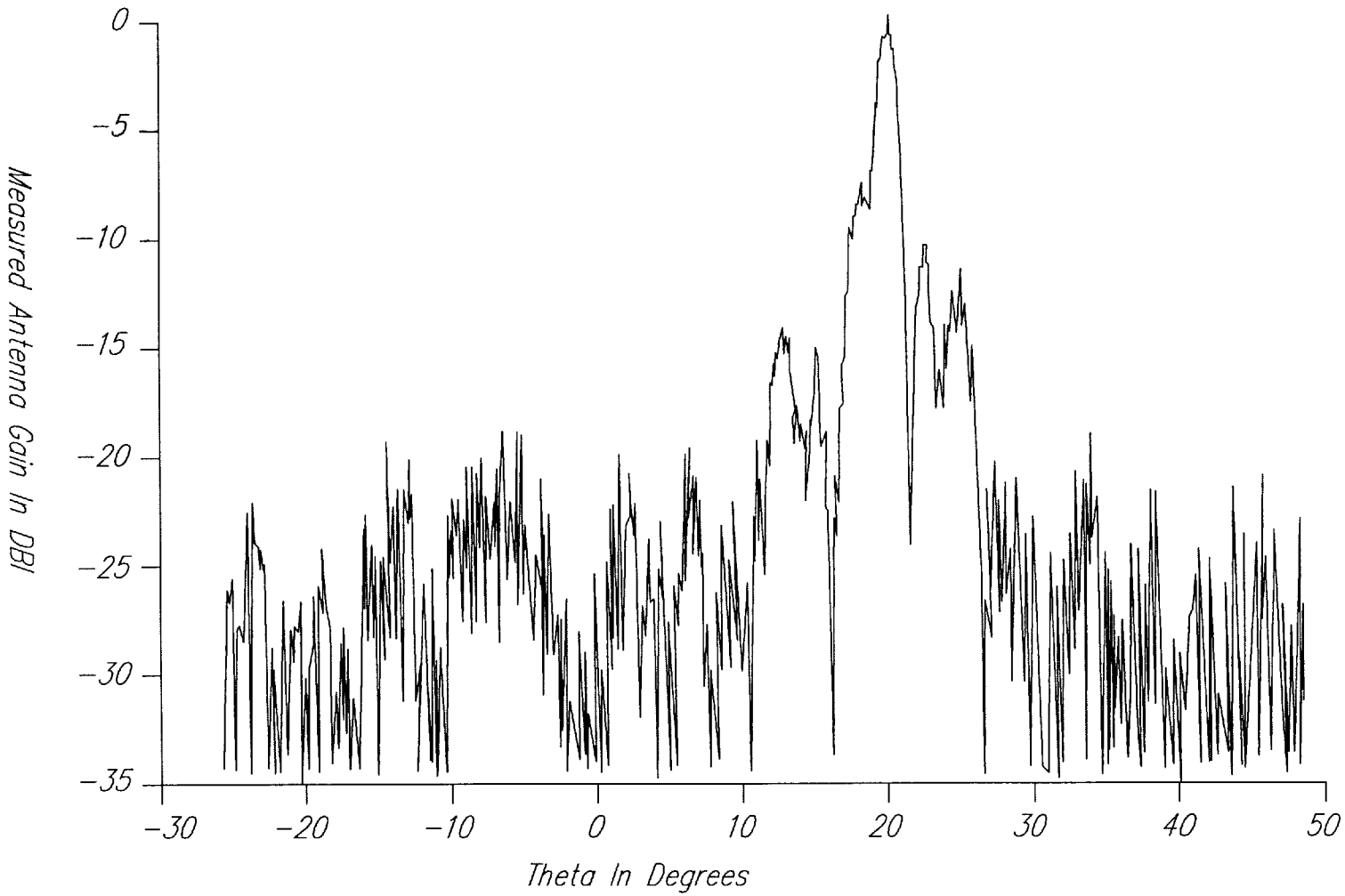
FIG. 7 is a graph of the measured antenna gain along the azimuthal axis of the antenna of the present invention.
Figure 5:
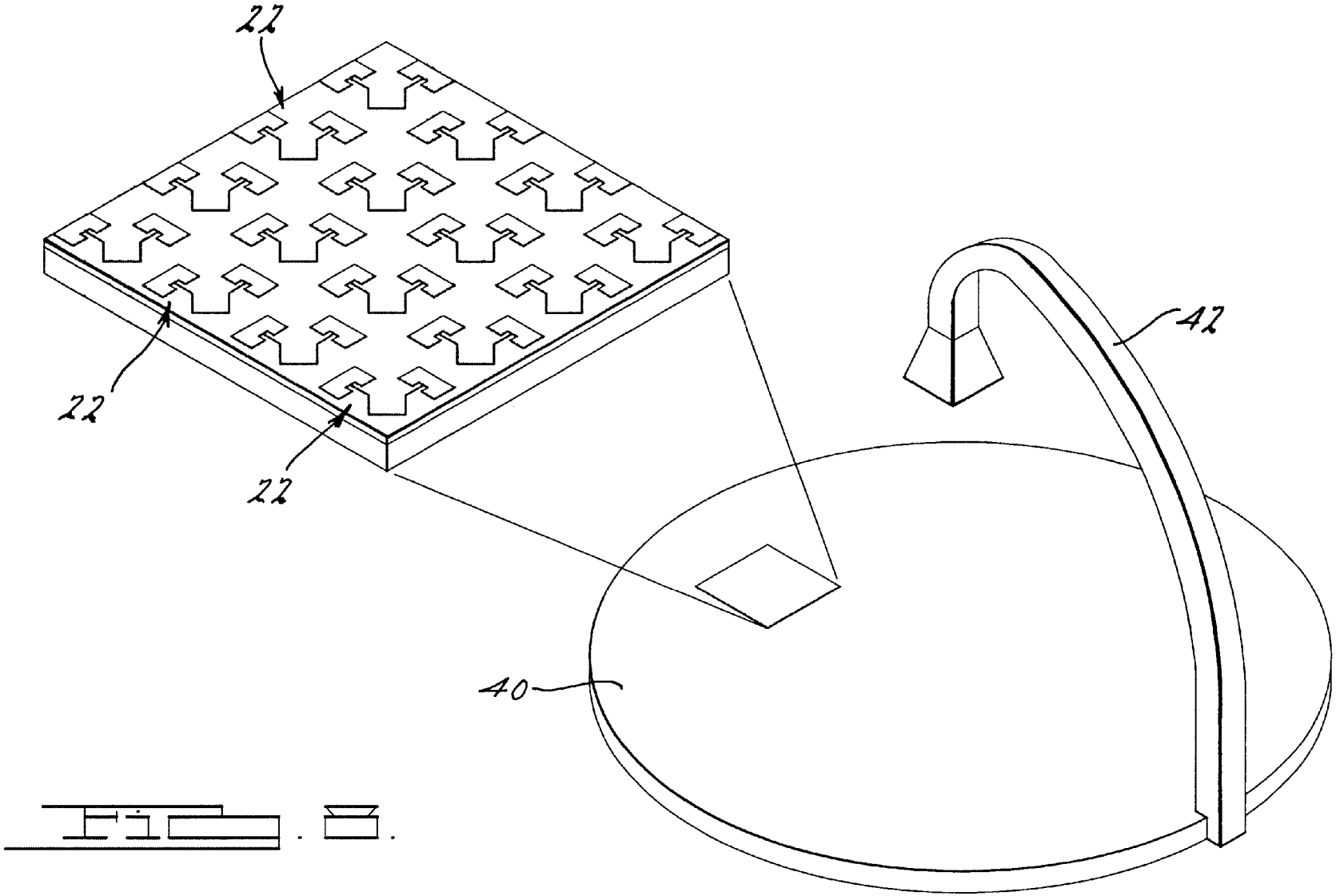

Referring to FIG. 6, a computer simulated graph is shown of the normalized far field cut patterns off of a single patch antenna unit 22 (as shown in FIG. 4) at 94 GHz, decomposed as co-polarization (horizontal polarization) and cross-polarization (vertical polarization) along (ϕ=0,90" by Ludwig's third definition of the polarization. Note that the incident field is vertically polarized (i.e., along the X-axis in FIG. 4), and the re-radiated field is predominantly polarization-twisted horizontal polarization (i.e., along the Y-axis in FIG. 4). At 94 GHz, the horizontal polarization level is 7.7dB higher than the vertical polarization level in the re-radiated field. In other words, the optimized antenna 10 converts more than 85% of the incident vertical polarization to horizontal polarization. The measured antenna pattern of the antenna 10 is shown in FIG. 7.

The flat reflectarray antenna 10 thus provides a space-fed, polarization twisting reflectarray approach that allows for a simple, compact and cost-effective antenna architecture while still maintaining robust RF performance at millimeter wave frequencies. The reflectarray antenna of the present invention advantageously produces a directed, collimated beam off of a flat surface, and thus will find many applications in the military and commercial fields. A particular advantage is that the reflectarray antenna 10 can be readily adapted for use with micro electromechanical (MEMS) phase shifters to provide an electronically scanned antenna. While the preferred embodiment has been illustrated in the form of an inverse Cassegrain configuration, it will be appreciated that the present invention could be formed in a J-feed configuration or a wide variety of other configurations.

As shown in FIG. 8, an array of patch-antenna units 22 can be mounted on a support 40 and illuminated by a J-feed 42 with two orthogonal linear polarizations. With only a single set of phase shifters, the array of patch antenna units 22 can provide a directed, dual-polarized beam.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A space fed, flat reflectarray antenna for producing a narrow beamwidth signal, comprising:

a feed horn for producing a polarized signal; and a reflectarray element responsive to said polarized signal for providing a polarization twist function to said polarized signal and to provide said narrow beamwidth signal;

said reflectarray element including a plurality of patch antenna units, each of said patch antenna units including a vertical polarization sensitive patch antenna, a horizontal polarization sensitive patch antenna, and a microstrip transmission line conjoining the vertical and horizontal sensitive patch antenna units and having a length sufficient to impart a predetermined phase shift to form said narrow beamwidth signal.

2. The reflectarray antenna of claim 1, further comprising a polarization sensitive subreflector.

3. The reflectarray antenna of claim 1 , wherein said reflectarray element further includes a planar ground plane and a dielectric substrate formed on said planar ground plane, said patch antenna units being disposed on said dielectric substrate.

4. The reflectarray antenna of claim 1, wherein each said patch antenna unit is excited by a vertically polarized signal.

5. The reflectarray antenna of claim 1, wherein said feed horn comprises a pyramidal feed horn disposed to produce a vertically polarized signal; and wherein said reflectarray antenna further includes a subreflector for reflecting a vertically polarized signal therefrom back to said reflectarray element.

6. A space fed, flat reflectarray antenna for producing a narrow directed, beamwidth signal, comprising:

a feed horn for producing a polarized signal; and a subreflector responsive to said polarized signal for providing a reflected polarized signal;

a reflectarray element responsive to said reflected polarized signal reflected by said subreflector for providing a polarization twist function to said reflected polarized signal to thereby generate said directed, narrow beamwidth signal;

said reflectarray element including:

a dielectric substrate; and a plurality of patch antenna units disposed on said dielectric substrate;

each of said patch antenna units including a vertical polarization sensitive patch antenna, a horizontal polarization sensitive patch antenna, and a microstrip transmission line conjoining the vertical and horizontal sensitive patch antennas and having a length sufficient to impart a predetermined phase shift to said reflected polarized signal received by one of said vertical or horizontal polarization sensitive patch antennas and transmitted by the other one of said patch antennas.

7. The reflectarray antenna of claim 6, further comprising a ground plane disposed on one surface of said dielectric substrate.

8. The reflectarray antenna of claim 6, wherein said feed horn produces a vertically polarized signal; and wherein said reflected polarized signal from said feed horn comprises a vertically polarized signal.

9. The reflectarray antenna of claim 6, wherein said microstrip transmission line of each said reflectarray element has a length selected to provide a phase shift of between 0 degrees and 315 degrees.

10. The reflectarray antenna of claim 6, wherein said microstrip transmission line of each said reflectarray element provides a phase shift, in 45 degree increments, between 0 and 315 degrees.

11. The reflectarray antenna of claim 6, wherein each of said patch antenna units is comprised within an area of approximately 0.080 inch×0.080 inch(2.032 mm×2.032 mm).

12. The reflectarray antenna of claim 6, further comprising a radome for supporting said subreflector.

13. A space fed, flat reflectarray antenna for producing a narrow beamwidth signal, comprising:

a feed horn for producing a vertically polarized signal;

a subreflector responsive to said vertically polarized signal for providing a reflected, vertically polarized signal; and a planar reflectarray element having an aperture within which said feed horn is disposed, said reflectarray element being responsive to said reflected, vertically polarized signal reflected by said subreflector and for providing a polarization twist function to said vertically polarized signal to provide a horizontally polarized, narrow beamwidth, collimated signal;

said reflectarray element including:

a dielectric substrate;

a ground plane formed on one surface of said dielectric substrate; and a plurality of patch antenna units disposed on said dielectric substrate;

each of said patch antenna units including a vertical polarization sensitive patch antenna, a horizontal polarization sensitive patch antenna, and a microstrip transmission line conjoining the vertical and horizontal sensitive patch antennas;

each said vertical polarization sensitive patch antenna operating to receive said reflected, vertically polarized signal and transmit said reflected, vertically polarized signal to said microstrip transmission line, wherein said microstrip transmission line imparts a predetermined phase shift to said reflected, vertically polarized signal, and wherein an output of said microstrip transmission line is received by said horizontal polarization sensitive patch antenna which produces a horizontally polarized signal forming said narrow beamwidth signal; and wherein said predetermined phase shift comprises a phase shift between 0 degrees and 315 degrees.

14. The reflectarray antenna of claim 13, wherein each said patch antenna comprises a cell having dimensions between about 0.080 inch×0.080 inch(2.032 mm×2.032.

15. The reflectarray antenna of claim 13, further comprising a radome for supporting said subreflector.

* * * * *